US005963995A

United States Patent [19]

Glass

[11] Patent Number: 5,963,995

[45] Date of Patent: Oct. 12, 1999

[54] PATIENT HANDLER BELT

[76] Inventor: Francis Glass, 6430 W. 11th St., Indianapolis, Ind. 46214

[21] Appl. No.: 09/005,498

[22] Filed: Jan. 12, 1998

[51] Int. Cl.[6] ..... A61G 7/10

[52] U.S. Cl. ..... 5/81.1 R; 5/89.1; 5/81 T

[58] Field of Search ..... 5/81.1 R, 89.1, 5/81.1 T, 494; 294/74; 2/69, 69.5, 80

[56] References Cited

U.S. PATENT DOCUMENTS

| | | | |
|---|---|---|---|
| 4,159,010 | 6/1979 | Mitro | 5/89.1 |
| 4,191,416 | 3/1980 | Nist | 5/89.1 |
| 4,802,244 | 2/1989 | McGrath-Saleh | 5/494 |
| 4,903,355 | 2/1990 | Hickerson | 5/89.1 |
| 4,944,057 | 7/1990 | Shaw | 5/89.1 |
| 4,981,307 | 1/1991 | Walsh | 5/89.1 |
| 5,168,587 | 12/1992 | Shutes | 5/81.1 T |
| 5,647,378 | 7/1997 | Farnum | 5/89.1 |

FOREIGN PATENT DOCUMENTS

| | | | |
|---|---|---|---|
| 182192 | 6/1955 | Austria | 5/89.1 |
| 13341 | 8/1890 | United Kingdom | 5/89.1 |

*Primary Examiner*—Michael F. Trettel
*Assistant Examiner*—Fredrick Conley
*Attorney, Agent, or Firm*—Daniel O'Connor

[57] ABSTRACT

A support device which is designed to be worn by a person to aid in movement and transfer of such person. The device is easy to put on and remove from the waist of a person who has suffered a stroke or has limited limb usage. The unit is formed so that, when being worn by the user, lateral handle areas are available for lifting or moving the person. The overall shape of the design provides support and comfort for the wearer.

1 Claim, 2 Drawing Sheets

PATIENT HANDLER BELT

BACKGROUND AND OBJECTS OF THE INVENTION

The present invention is generally related to the patient handling arts and, in particular, to a novel method and device for movement and transfer of a patient who may not be able to control his or her limbs. For example, the design has utility with stroke or amputation patients.

Prior art designs have included the traditional gait belt which does work well for some uses. However, it has been discovered by the inventor herein that an increased support belt may function better for some patients.

Prior art designs have also proven to be rather cumbersome to use in practice and uncomfortable for the patient.

Accordingly, it is an object of the invention to show a novel patient support and lift belt which provides an increased support in the back and mid-body areas for easier handling of the patient.

It is also an object of the invention to demonstrate a patient support belt which is easily used and secured comfortably to the patient.

It is a still further object of the invention to provide a handler belt which is easily concealed and washable for long product life.

It is also an object of the invention to show a handler support belt in which side handle areas are formed to provide efficient lifting support and increased comfort for the person wearing the support belt.

These and other objects and advantages of the present invention will be apparent to those of skill in the art from the description which follows.

PRIOR ART PATENTS AND DESIGNS

The following patents are generally related to the present invention in that they show patient lifting and supporting devices:

U.S. Pat. No. 5,499,408 issued for a patient lifting device in 1996;

U.S. Pat. No. 3,859,677 issued for a patient carrying sling having a lower body support element.

The prior art designs, while effective, have proven to be somewhat cumbersome to use in practice and rather costly to manufacture for widespread commercial sales.

In contrast, the present invention is economical to manufacture and very easy to use in a practical patient care environment.

SUMMARY OF THE INVENTION

The design includes a belted front panel and a belted rear panel.

Each of the belts includes Velcro attaching means and are shaped so that they may cooperatively connect around the waist of the wearer to form lateral handle areas.

The side or lateral handle areas enable the wearer to be easily moved by another.

A reduced area crotch section provides support and comfort for the user.

The design is such that it may be easily put on or removed as needed.

The design may be readily mass-produced for widespread commercial appeal and use.

The materials utilized may be vinyl or cloth items or equivalent washable materials for long life and use of the device.

BRIEF DESCRIPTION OF THE DRAWING FIGURES

DESCRIPTION OF A PREFERRED EMBODIMENT

Figure 1:
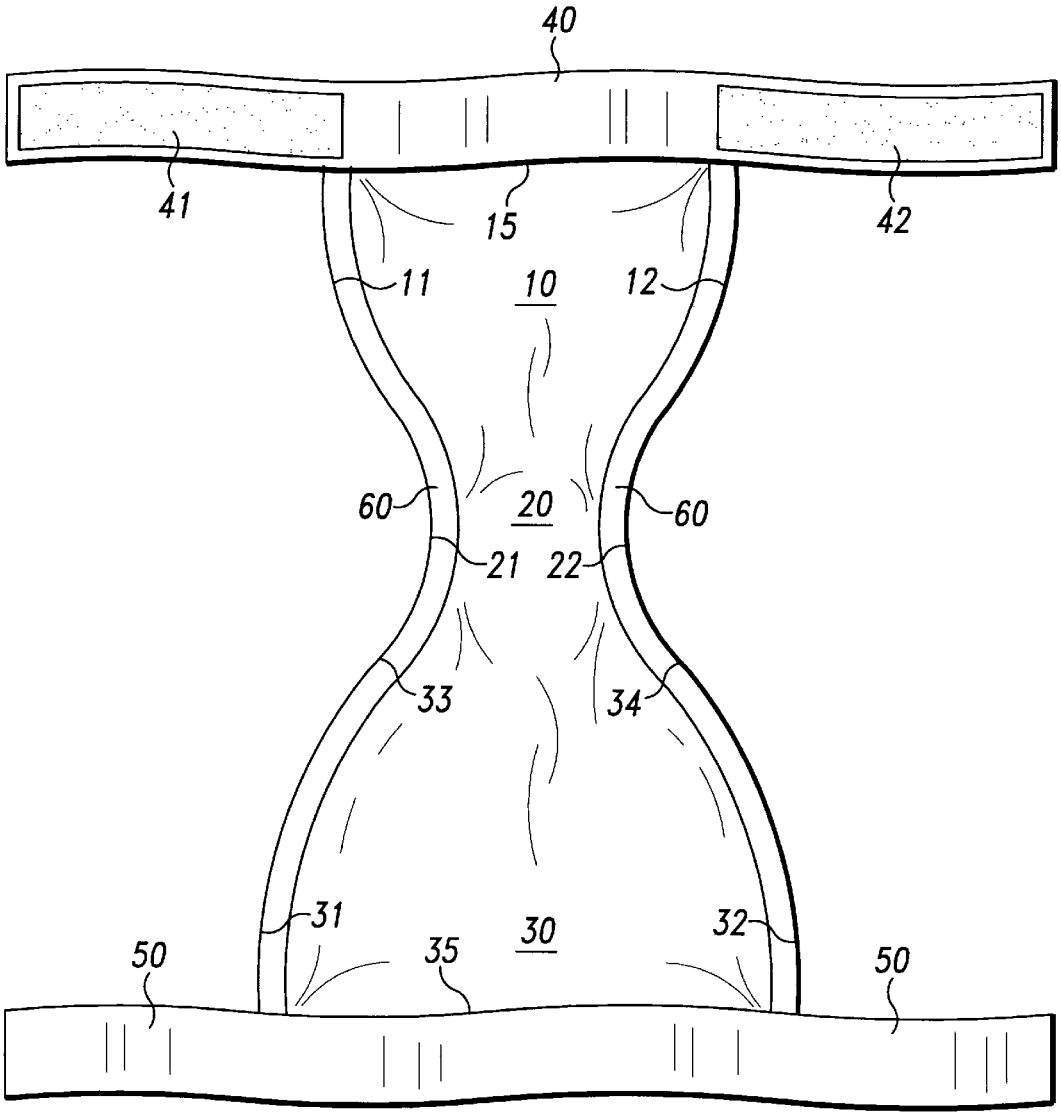
FIG. 1 shows a top view of the device in a flat or laid out position. It shows the front and rear panel belts and the overall shape of the design.

Referring to the drawing figures, FIG. 1 shows the handler belt in a flat or open position.

As shown, a front panel 10 has a straight upper edge 15 and widened side edges 11 and 12. The widened side edges 11 and 12 taper into a reduced area portion as indicated at numerals 13 and 14.

The smaller central or crotch area of the unit is shown at numeral 20 as having side edges at numerals 21 and 22.

The handler device further comprises a widened rear panel 30 with side edges 31 and 32 tapering, as shown at numerals 33 and 34, into the central or crotch area 20.

The rear panel 30 also includes a straight edge means 35 which is designed to be sewn or attached to an elongated belt element 50.

Correspondingly, the front panel 10 has a belt means 40 sewn or attached to its straight edge portion 15.

As further shown in FIG. 1, the unit may include stitched or reinforced edges 60 to add strength to the overall design.

Each of the elongated belt elements 40 and 50 has a pair of Velcro edge sections formed thereon.

The Velcro edge sections for belt 40 are indicated at numerals 41 and 42 of FIG. 1. The Velcro edge sections for belt 50, numerals 51 and 52, are on the underside of belt 50 and are thus not shown in FIG. 1 but are shown in the closed or in-use position of FIG. 2.

Figure 2:
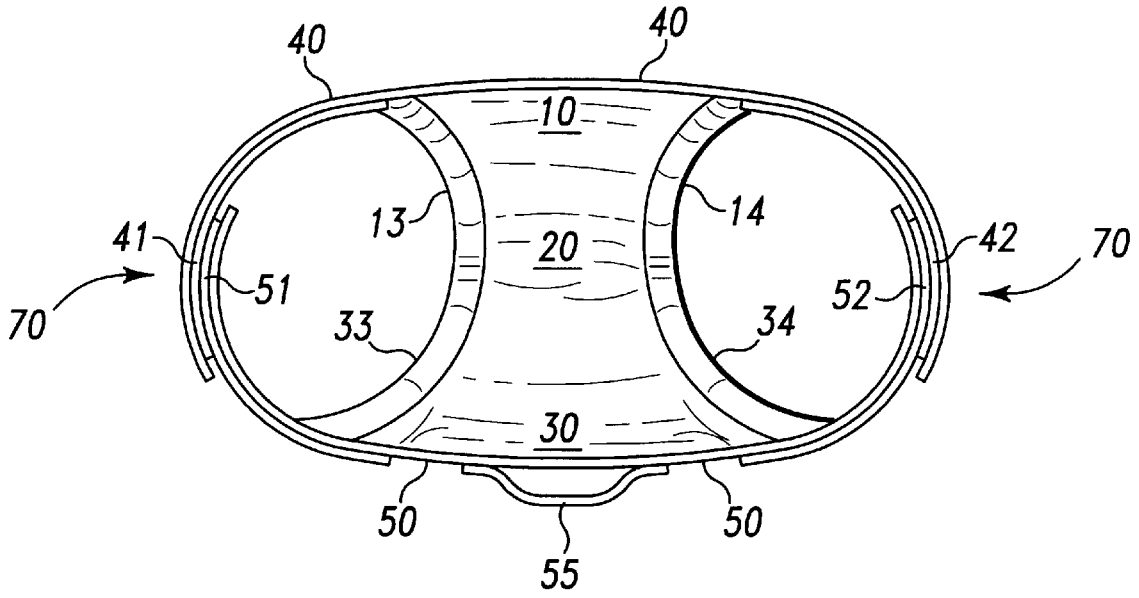
FIG. 2 shows an end top view of the device in a closed or applied position and illustrates how the belt elements co-operate to form side handle areas which enable the wearer to be easily lifted or moved.

The large area and location of the Velcro sections 41, 42, 51 and 52 are important features of the invention regarding the formation of lateral or side lifting areas shown at numerals 70 in FIG. 2.

For example, in the unit shown, each of the Velcro sections 41, 42, 51 and 52 would comprise an approximately 2-inch by 8-inch area or 16 square inches.

Thus, when the belts 40 and 50 are attached to each other, as indicated in the closed or in-use position of FIG. 2, the lateral handling areas 70 each have up to sixteen square inches of Velcro attaching support—more than enough to enable the lifting and movement of a person via the laterally formed handles 70.

FIG. 2 shows the joining of belts 40 and 50 via attachment of sections 41 and 51 and sections 42 and 52, respectively, to form the lateral handle areas 70.

The end or closed view of FIG. 2 also shows the unit components such as the front panel 10, the central or crotch area 20 and the rear panel 30.

The tapering portions 13, 14, 33 and 34 are also shown in FIG. 2.

FIG. 2 further shows a rear handle element 55 which is formed on the rear panel 30 to provide means to aid and guide a person while walking.

The materials utilized for the invention comprise cloth, vinyl or equivalent washable materials to give the unit a long and useful life.

The belts 40 and 50 may be sewn to the handler along lines 15 and 35 or the unit may be made in a one-piece design depending upon particular manufacturing needs and unit production costs.

The method steps of using the handler device consist of:

placing the person on the unit or sliding the unit under the person, turning the front and rear panels 10 and 30 up around the abdomen and posterior of the person, attaching the belt means 40 and 50 to form handles 70, lifting the person via the lateral handles 70.

The person assisting the disabled person simply places his/her hands around the laterally formed handles 70 and a supporting lifting or movement of the patient may be readily achieved with maximum comfort for the patient.

The unit may thus be easily put on or removed as needed or desired by the patient.

While a particular embodiment has been shown and described, it is intended in this specification to cover all equivalent structures and modifications which would reasonably occur to those of skill in the art.

The invention is further defined by the claims appended hereto.

I claim:

1. A patient handler support belt to provide ease of lifting and movement comprising: a front panel having widened upper side edges and lower tapered side edges, said front panel having an upper straight edge, a central panel having narrowed side edges, a rear panel having widened side edges and tapered side edge for connection to said central panel, said rear panel having a straight edge portion, a first belt running along said front panel straight edge and extending beyond the upper side edges thereof, a second belt running along said rear panel straight edge and extending beyond the upper side edges thereof, means for attaching said first belt to said second belt and for providing lateral handle areas so that a person wearing the device may be easily lifted and moved, said means for attaching said first belt to said second belt comprise elongated hook and loop areas on lateral edges of said respective belts, said hook and loop areas for said first belt being located on an upper side thereof and said hook and loop areas for said second belt are located on a lower side thereof, said hook and loop areas being approximately eight inches in length, said first and second belts providing means for placing the support belt under the person and for turning the front and rear panels up around the abdomen and posterior of the person.

* * * * *